US006022194A

United States Patent [19]

Amos et al.

[11] Patent Number: 6,022,194

[45] Date of Patent: Feb. 8, 2000

[54] LINEAR PRICTION WELDING OF STEEPLES AND DEVICE THEREOF

[75] Inventors: Dennis Ray Amos, Rock Hill, S.C.; Sallie Ann Bachman, Oviedo, Fla.

[73] Assignee: Siemens Westinghouse Power Corporation, Orlando, Fla.

[21] Appl. No.: 08/877,844

[22] Filed: Jun. 18, 1997

[51] Int. Cl.[7] ..... F04D 29/34

[52] U.S. Cl. ..... 416/219 R; 416/213 R; 416/241 R; 416/204 A; 29/889.21

[58] Field of Search ..... 416/204 A, 219 R, 416/226 R, 213 R, 248, 239, 241 R; 29/889, 889.21, 889.23; 228/112.1

[56] References Cited

U.S. PATENT DOCUMENTS

| | | | |
|---|---|---|---|
| 4,940,390 | 7/1990 | Clark et al. | 416/241 R |
| 5,024,582 | 6/1991 | Bellows et al. | 416/213 R |
| 5,486,262 | 1/1996 | Searle | 156/580 |
| 5,492,581 | 2/1996 | Searle | 156/73.5 |
| 5,746,579 | 5/1998 | Amos et al. | 416/204 A |

*Primary Examiner*—Edward K. Look
*Assistant Examiner*—Richard Woo
*Attorney, Agent, or Firm*—Eckert Seamans Cherin & Mellott, LLC

[57] ABSTRACT

The invention provides a blade-rotating device for rotating a plurality of radially-oriented blades having a blade base with two grooved base sides. The device has a portion, such as a disc or a rotor disc of a turbine, for rotating the blades with the portion having an outer cylindrical surface. The device also has a plurality of steel steeples each having a steeple base and two opposite grooved steeple sides extending therefrom. Each of the opposite steeple sides complements at least one of the grooved sides of at least one of the blade bases. The steeple bases are linear friction welded to the outer cylindrical surface in an approximately longitudinal direction such that the blade bases are engagable with the steel steeples.

48 Claims, 5 Drawing Sheets

LINEAR PRICTION WELDING OF STEEPLES AND DEVICE THEREOF

BACKGROUND OF THE INVENTION

1. Field of the Invention

This invention relates to turbines. More specifically, this invention relates to the engagement of blades onto discs or rotor discs of turbines.

2. Description of the Related Art

Steam turbines and rotors are constructed of discs or rotor discs that have a number of circumferentially disposed projecting steeples. During service, these steeples can be distressed in a number of ways. The steeples may incur mechanical damage from foreign objects. Also, the steeples are susceptible to stress corrosion cracking and pitting, corrosion, erosion corrosion, high cycle fatigue, and other factors. The environment in especially low pressure steam turbines, with all of its steam borne corroding components, promotes the corrosion of the steeples. These damage mechanisms evidence themselves by pitting and cracking the steeples and surrounding rim area, or substantial metal wastage thereof, and can lead to scrapping the entire rotor at great expense to the operator.

Now referring to Prior Art FIG. 1, the prior art discloses that the steeples on a disc 10 can be repaired by removing the distressed steeples and restoring the area with a solid weld metal buildup 12. The buildup 12 is then machined down to form a replacement steeple 14. A space 16 on disc 10 is where there was previously a distressed steeple that has been removed to prepare for another solid weld metal buildup.

The solid weld metal buildup method of steeple repair has prohibitive lead times and costs. A disc, particularly one used in a nuclear steam turbine which is more prone to stress corrosion cracking, may be as large as 100 inches in diameter. Repairing the steeples on an entire disc can take between 500 and 1000 hours. This time can be increased if weld defects are detected and corrected. Therefore, it is clear that a more economical method to repair the steeples is needed.

SUMMARY OF THE INVENTION

The invention provides a blade-rotating device for rotating a plurality of radially-oriented blades having a blade base with two grooved base sides. The device has a portion, such as a disc or a rotor disc of a turbine, for rotating the blades with the portion having an outer cylindrical surface. The device also has a plurality of steel steeples each having a steeple base and two opposite grooved steeple sides extending therefrom. Each of the opposite steeple sides complements at least one of the grooved sides of at least one of the blade bases. The steeple bases are linear friction welded to the outer cylindrical surface in an approximately longitudinal direction such that the blade bases are engagable with the steel steeples.

BRIEF DESCRIPTION OF THE DRAWINGS

Prior Art

DETAILED DESCRIPTION OF THE PREFERRED EMBODIMENTS

Figure 1:
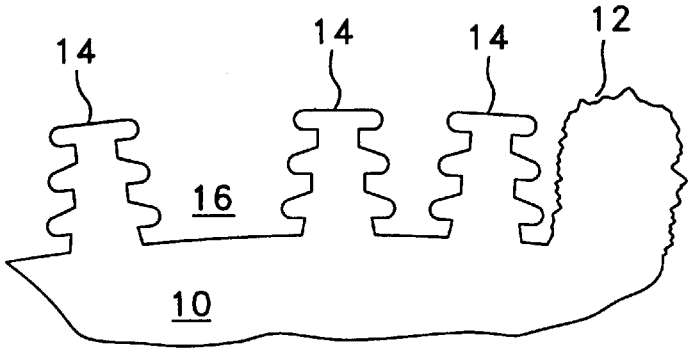
FIG. 1 (PRIOR ART)
FIG. 1 is a detail view of steeples on a disc being replaced using prior art techniques.
Figure 2:
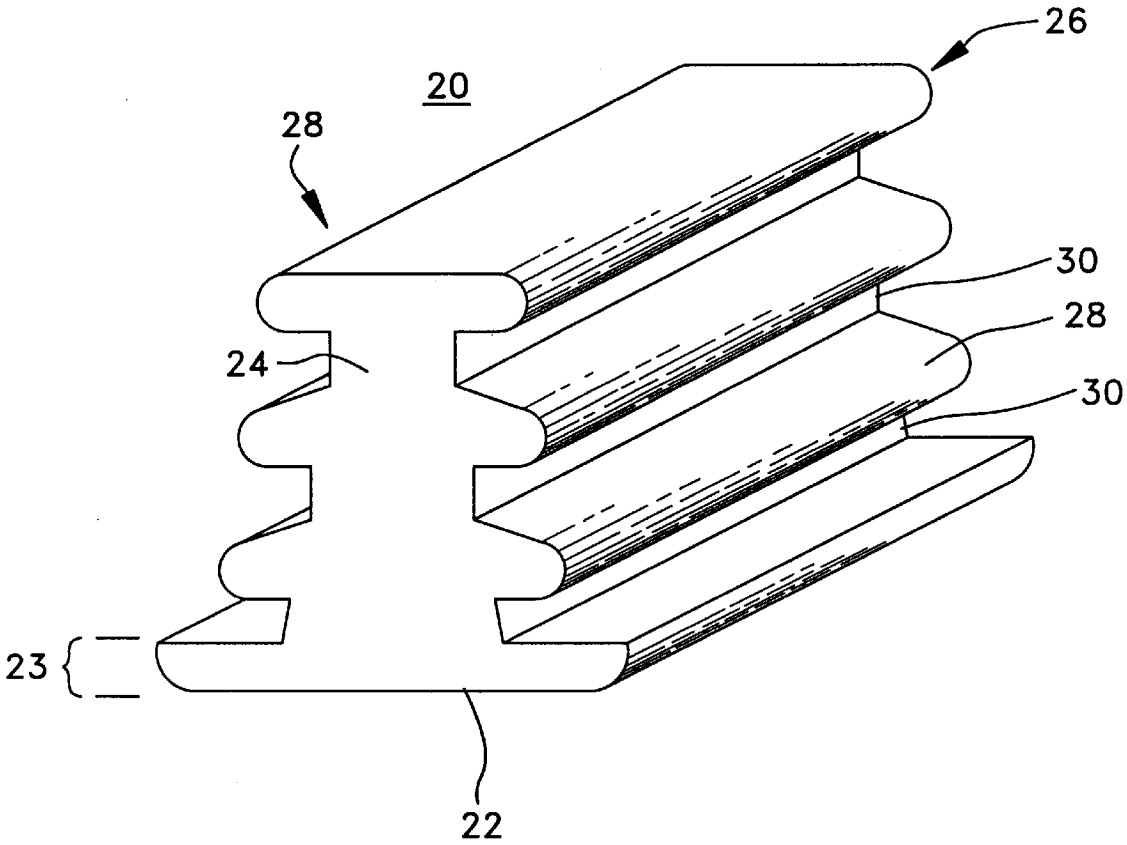
FIG. 2 is a perspective view of a steel steeple according to the claimed invention.

Referring to the drawings, wherein like reference numerals refer to like elements, there is shown in FIG. 2 a steel steeple 20 having a steeple base 22 of a thickness 23. The steeple may be forged, hot-rolled, or any other suitable steeple type. The steeple 20 has a front end 24, a back end 26 (not shown), and two opposite, grooved steeple sides 28 extending therefrom. The grooved steeple sides 28 have grooves 30 extending from the front end 24 to the back end 26. The grooved steeple sides 28 are designed to complement the blade base 44 of the blades 42, which is discussed below (see description of FIGS. 7 and 8). While the embodiment of the invention shown in FIG. 2 is a straight steeple, other embodiments of the invention may have steeples that are curved or skewed. In a preferred embodiment of the invention, the steeple 20 may be oversized, In a further preferred embodiment of the invention, the steel steeple may be oversized 0.070 inches.

In a preferred embodiment of the invention, the steel steeple may be made of a NiCrMoV alloy. In a more preferred embodiment of the invention, the steel steeple may comprise 9% to 17% chromium. In a further preferred embodiment of the invention, the steel steeple may comprise approximately 12% chromium. These percentages of chromium provide enhanced corrosion resistance to the steel steeple 20. In another preferred embodiment, the alloy may be 3.5 NiCrMoV alloy.

Figure 3:
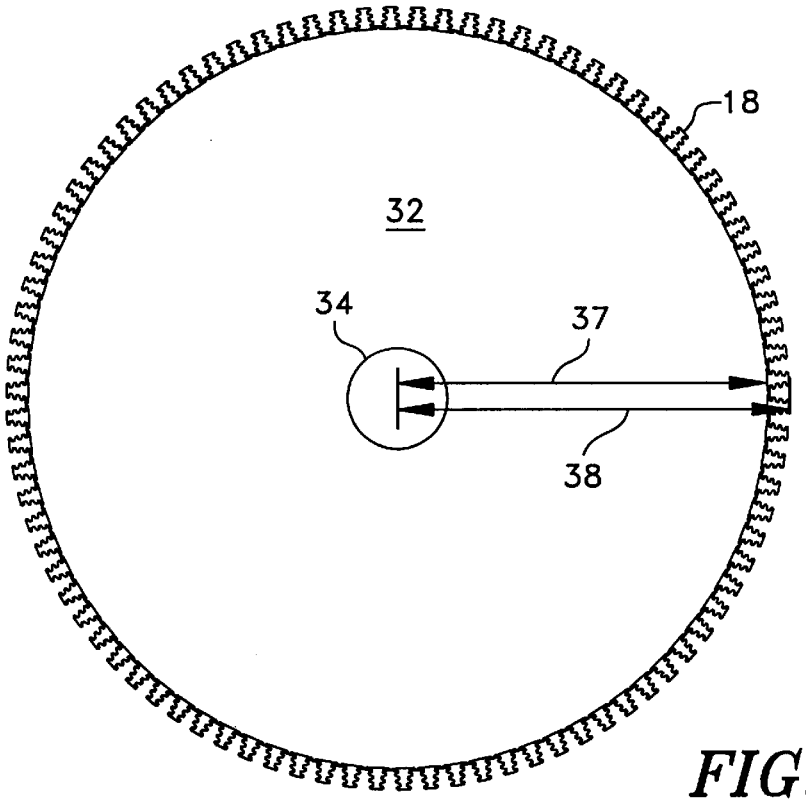
FIG. 3 is a view of a disc with the original steeples.

Now referring to FIG. 3, a disc 32 is a rotating means for rotating a plurality of radially-oriented blades 42 (see FIG. 8), having original steeples 18 disposed around its circumference. The disc 32 of FIG. 3 is shown prior to its preparation for linear friction welding the steeples 20 thereon. The disc 32 has a bore 34 extending therethrough for mounting the disc on a shaft (not shown). Other embodiments of the invention may use a rotor disc that is integral to the rotor (not shown). Details of the arrangement of discs on a shaft or of a rotor disc are disclosed in commonly assigned, co-pending application filed on Dec. 27, 1996 entitled "STRESS CORROSION RESISTANT RIMS AND DISCS FOR STEAM TURBINE ROTORS DEVICE AND METHOD", Ser. No. 08/775,075, which is incorporated herein by reference in its entirety. The disc 32 has a radius 37 that does not include the original steeples 18 and an overall radius 38 that does include the original steeples.

Figure 4:
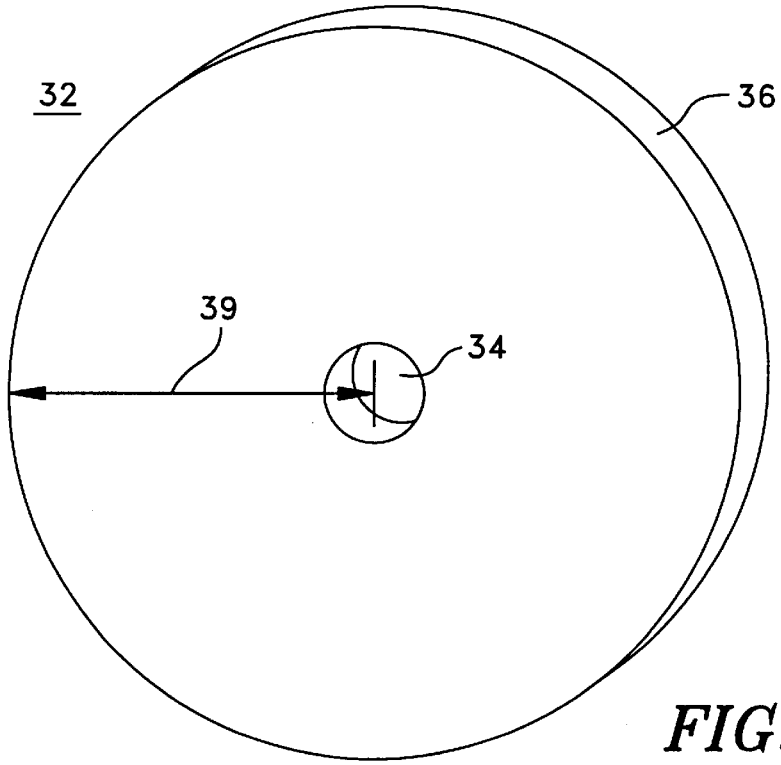
FIG. 4 is a perspective view of a disc according to the claimed invention.

Now referring to FIG. 4, the disc 32 has been prepared to have the steel steeples 20 linear friction welded thereon. The original steeples 18 have been removed and an outer cylindrical surface 36 has been prepared to accept the steeples 20. Other embodiments of the invention may remove only a portion of the original steeples 18. Also, the radius of the disc 32 has been reduced to a radius 39, which is radius 37 minus the thickness 23 of the steeple base 22. The reduced radius 39 is to ensure that the overall radius 38 remains the same after linear friction welding the steeples 20 onto the disc 32. In an embodiment of the invention, the outer cylindrical surface 36 may be cladded.

Figure 5:
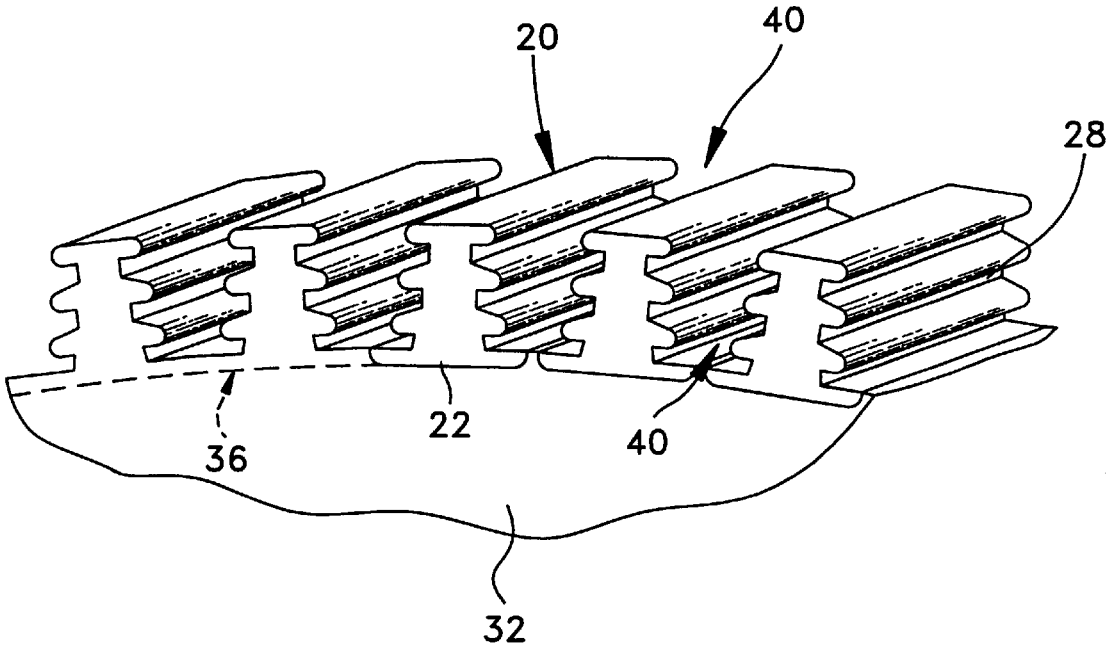
FIG. 5 is a sectional perspective view of steel steeples that have been linear friction welded onto the disc as per the claimed invention.

Now referring to FIG. 5, the steel steeples 20 have been linear friction welded onto the outer cylindrical surface 36. Examples of linear friction welding are disclosed in U.S. Pat. No. 5,486,262 to Searle entitled "Friction Welding"; and U.S. Pat. No. 5,492,581 to Searle entitled "Friction Welding", both of which are incorporated herein by reference in their entireties. A steeple 20 is linear friction welded onto the outer cylindrical surface 36 by reciprocating at least one of them, preferably the steeple, and urging the two together such that the frictional heat generated between the components melts the material of at least one of the steeple 20 and the surface 36, and usually both, so as to form a friction weld.

The steeples 20 are linear friction welded to the outer cylindrical surface 36 in an approximately longitudinal direction such that the grooved steeple sides 28 face an opposing steeple side 28 of an adjacent steeple. These pairs of facing steeple sides 28 complement at least one of the blade bases 44 (described below) and define grooved valleys 40. In a preferred embodiment of the invention, the steel steeples 20 are machined to remove the oversized portion thereon. It is estimated that the invention requires 30 seconds to friction weld a steeple onto the disc, or two hours to completely friction weld the steeples onto the disc, compared to the 500 to 1000 hours required in the weld metal buildup method.

Figure 6:
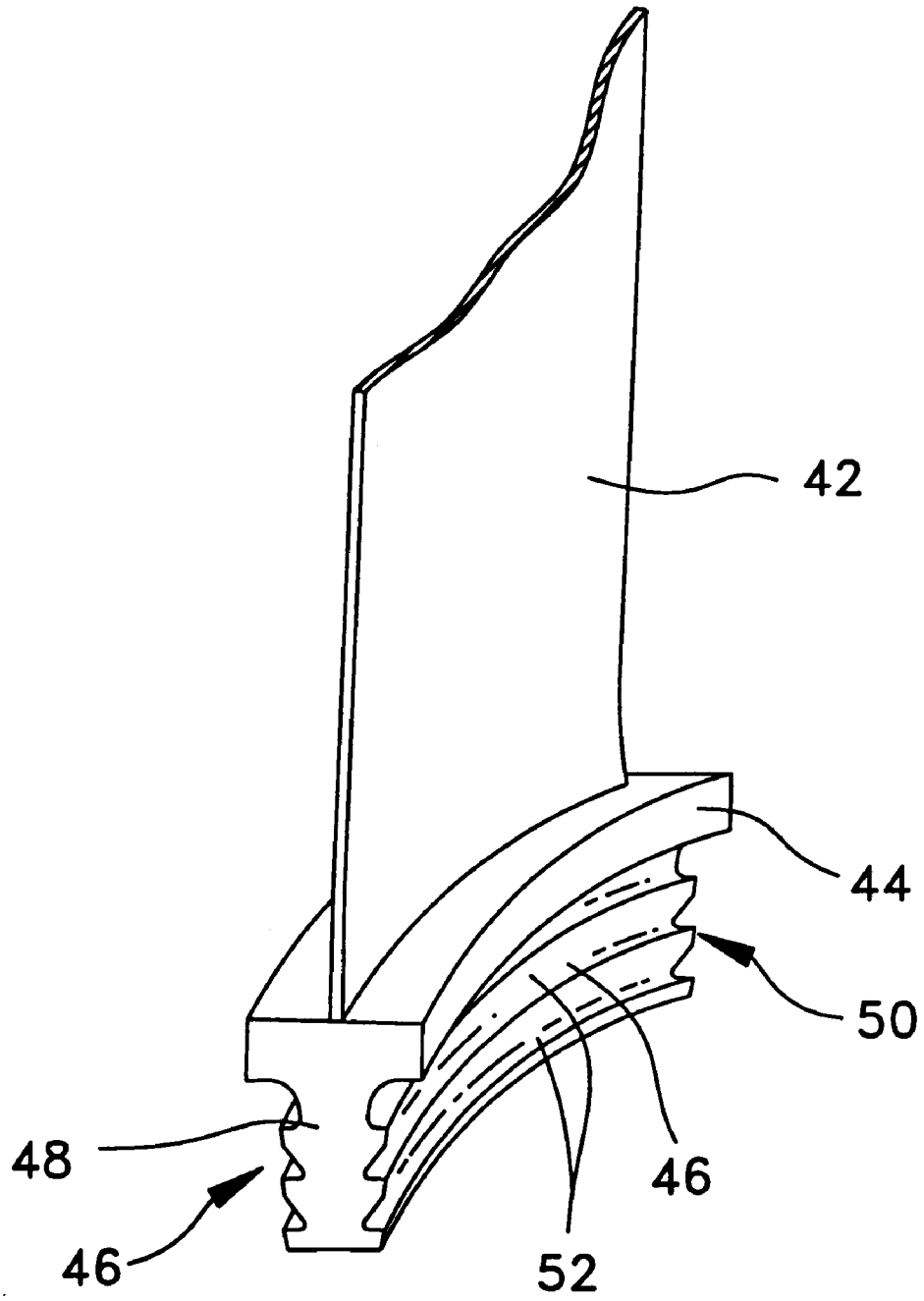
FIG. 6 is an example of a typical turbine blade.
Figure 8:
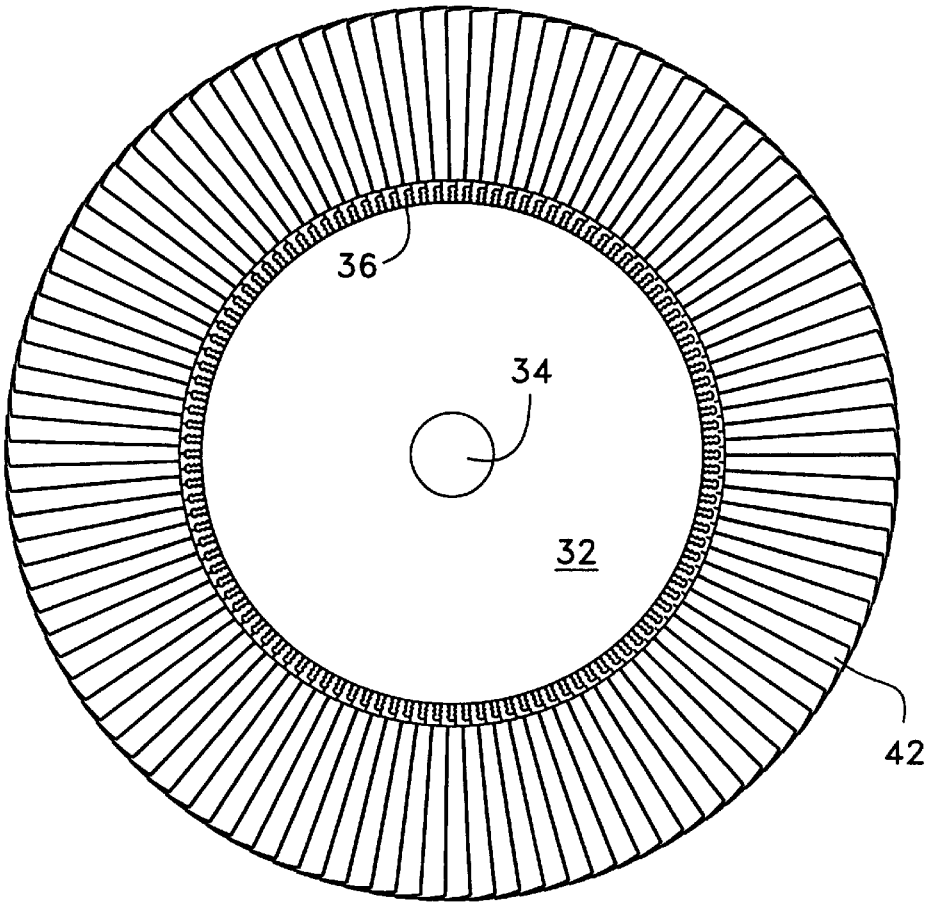
FIG. 8 is an example of a typical disc with radially-oriented blades engaged with the steel steeples of the claimed invention.

Now referring to FIG. 6, blade 42 is an example of blades commonly used in conjunction with the invention. FIG. 6 shows the blade base 44 and a bottom portion of the blade 42 extending therefrom to enable viewing of the blade base 44 details. The blade 42 extends further up, as shown in FIG. 8. Extending from the bottom of the blade is the blade base 44 having two opposite grooved base sides 46, a front end 48, and a back end 50. The grooved base sides 46 have grooves 52 extending from the front end 48 to the back end 50. The blade base 44 may be curved, as is shown in FIG. 6, straight, or skewed.

Figure 7:
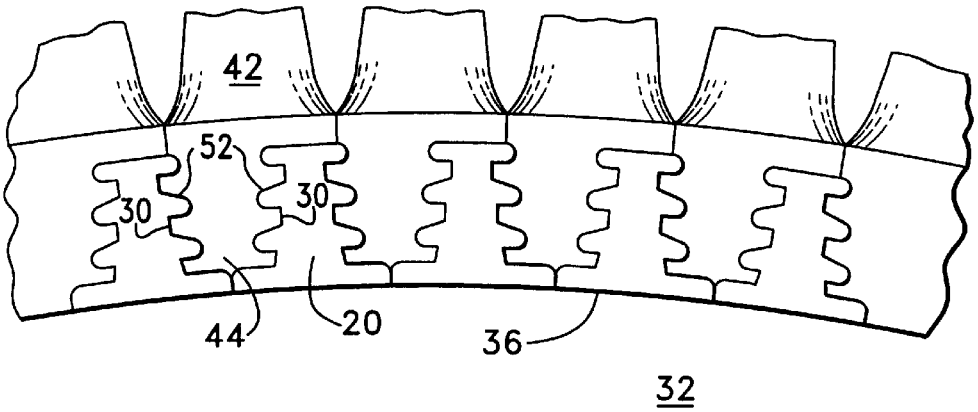
FIG. 7 is a detail of turbine blades engaged with the steel steeples of the claimed invention.

Now referring to FIG. 7, a plurality of blade bases 44 are disposed in the grooved valleys 40 between the steel steeples 20. The grooved steeple sides 28 that define each grooved valley 40 complement and engage the blade base 44 disposed therein. The disposing of the blade bases 44 into the grooved valleys 40 radially orients the blades 42 around the disc 32. The grooves 30 in the grooved steeple sides 28 and the grooves 52 in the grooved base sides 46 are designed such that when the disc 32 rotates the blades 42, the blades remain relatively static compared to the outer cylindrical surface 36 and do not move in a radial direction.

Now referring to FIG. 8, the disc 32 has an entire set of blade bases 44 disposed in the grooved valleys 40 formed by the steel steeples 20 that have been linear friction welded onto the outer cylindrical surface 36 of the disc 32 such that the blades 42 are radially oriented.

The invention may be practiced not only in conjunction with repairing discs and rotor discs, but it also may be practiced in fabricating new discs and rotor discs. Consequently, the present invention may be embodied in other specific forms without departing from the spirit or essential attributes thereof and, accordingly, reference should be made to the appended claims, rather than to the foregoing specification, as indicating the scope of the invention.

We claim:

1. A blade-rotating device for rotating a plurality of radially-oriented blades having a blade base with two grooved base sides, comprising:

a) rotating means for rotating said blades, with an outer cylindrical surface;

b) a plurality of steel steeples comprising a steeple base and two opposite grooved steeple sides extending therefrom, wherein each of said opposite steeple sides complements at least one of the grooved sides of at least one of the blade bases and wherein said steeple bases being linear friction welded to said outer cylindrical surface in an approximately longitudinal direction such that the blade bases are engagable with said steel steeples.

2. The device of claim 1, wherein the two grooved base sides of at least a portion of the blade bases are engaged with a portion of said steel steeples.

3. The device of claim 1, wherein said steeples are straight, skewed, or curved.

4. The device of claim 1, wherein said rotating means comprises a disc.

5. The device of claim 1, wherein said steeples are comprised of a steel alloy having approximately 9% to 17% chromium.

6. The device of claim 5, wherein said steel alloy has approximately 12% chromium.

7. The device of claim 1, wherein said steeples are comprised of a NiCrMoV alloy.

8. The device of claim 7, wherein said steeples are comprised of a 3.5 NiCrMoV alloy.

9. The device of claim 1, wherein said rotating means comprises a rotor disk.

10. The device of claim 1, wherein said rotating means has a radius, said plurality of steeple bases have a thickness, and said radius has been reduced by an amount equivalent to said steeple base thickness to a smaller radius at the location of said linear friction welding.

11. A process for fabricating a blade rotating device for rotating a plurality of radially-oriented blades having a blade base with two grooved sides, comprising the steps of:

a) providing:

i) rotating means for rotating the blades, with an outer cylindrical surface; and ii) a plurality of steel steeples comprising a steeple base and two opposite steeple sides extending therefrom, wherein each of said opposite steeple sides complements at least one of the grooved sides of at least one of the blade bases; and b) linear friction welding said steeple bases to said outer cylindrical surface in an approximately longitudinal direction such that the blade bases are engagable with said steel steeples.

12. A device manufactured according to the process set forth in claim 11.

13. The process of claim 11, further comprising the step of machining off an oversized portion of said steel steeples after the linear friction welding step.

14. A device manufactured according to the process set forth in claim 13.

15. The process of claim 13, further comprising the step of engaging the blade bases with said steel steeples.

16. The process of claim 11, wherein said providing step further comprises the step of providing a disc for rotating the blades.

17. The process of claim 11, wherein said providing step further comprises the step of providing steeples comprised of a steel alloy having approximately 9 to 17% chromium.

18. The process of claim 17, further comprising the step of cladding said outer cylindrical surface prior to said linear friction welding step.

19. A device manufactured according to the process set forth in claim 18.

20. The process of claim 11, wherein said providing step further comprises the step of providing steeples comprised of a steel alloy having approximately 12% chromium.

21. The process of claim 20, further comprising the step of cladding said outer cylindrical surface prior to said linear friction welding step.

22. A device manufactured according to the process set forth in claim 21.

23. The process of claim 11, further comprising the step of removing at least a portion of original steeples on said outer cylindrical surface prior to said linear friction welding step.

24. The process of claim 11, wherein said providing step further comprises the step of providing a plurality of steel straight, skewed, or curved steeples.

25. The process of claim 11, wherein said providing step further comprises the step of providing steeples comprised of a NiCrMoV alloy.

26. A device manufactured according to the process set forth in claim 25.

27. The process of claim 25, wherein said providing step further comprises the step of providing steeples comprised of a 3.5 NiCrMoV alloy.

28. A device manufactured according to the process set forth in claim 27.

29. The process of claim 11, wherein said providing step further comprises the step of providing a rotor disk for rotating the blades.

30. The process of claim 11, wherein said providing step further comprises the step of providing a disk having a radius;

providing a plurality of steeples with bases having a thickness; and further comprising the step of reducing said radius by an amount equivalent to said steeple base thickness at the location of said linear friction welding.

31. A device manufactured according to the process set forth in claim 30.

32. A process for replacing an original steeple on a blade rotating device for rotating a plurality of radially-oriented blades having a blade base with two grooved sides, comprising the steps of;

a) providing:

i) rotating means for rotating the blades, with a radius and an outer cylindrical surface;

ii) a plurality of original steel steeple comprising a steeple base and two opposite steeple sides extending therefrom attached to said rotating means, wherein each of said opposite steeple sides complements at least one of the grooved sides of at least one of the blade bases; and iii) a new steel steeple comprising a steeple base having a thickness and two opposite steeple sides extending therefrom, wherein each of said opposite steeple sides complements at least one of the grooved sides of at least one of the blade bases; and b) removing at least one of said plurality of original steeples;

c) reducing said radius by an amount equal to said steeple base thickness at the location of said removed original steeple;

d) linear friction welding said new steeple base to said outer cylindrical surface in a approximately longitudinal direction such that the blade bases are engagable with said steel steeples.

33. A device manufactured according to the process set forth in claim 32.

34. The process of claim 32, further comprising the step of machining off an oversized portion of said new steel steeple after the linear friction welding step.

35. A device manufactured according to the process set forth in claim 34.

36. The process of claim 34, further comprising the step of engaging the blade bases with said steel steeples.

37. The process of claim 32, wherein said providing step further comprises the step of providing a disc for rotating the blades.

38. The process of claim 32, wherein said providing step further comprises the step of providing a new steeple comprised of a steel alloy having approximately 9 to 17% chromium.

39. The process of claim 38, further comprising the step of cladding said outer cylindrical surface prior to said linear friction welding step.

40. A device manufactured according to the process set forth in claim 39.

41. The process of claim 32, wherein said step further comprises the step of providing a new steeple comprised of a steel alloy having approximately 12% chromium.

42. The process of claim 41, further comprising the step of cladding said outer cylindrical surface prior to said linear friction welding step.

43. A device manufactured according to the process set forth in claim 42.

44. The process of claim 32, wherein said providing step further comprises the step of providing a plurality of steel straight, skewed, or curved steeples.

45. The process of claim 32, wherein said providing step further comprises the step of providing new steeples comprised of a NiCrMoV alloy.

46. A device manufactured according to the process set forth in claim 45.

47. The process of claim 45, wherein said providing step further comprises the step of providing new steeples comprised of a 3.5 NiCrMoV alloy.

48. A device manufactured according to the process set forth in claim 47.

* * * * *